United States Patent [19]

Shaw et al.

[11] Patent Number: 4,764,123

[45] Date of Patent: Aug. 16, 1988

[54] ELECTRICAL CONNECTORS

[75] Inventors: Ronald Shaw, Sunderland; Leonard Jackson, Cullercoats; Anthony Headley, Whickham, all of England

[73] Assignee: Northern Engineering Industries plc, Newcastle upon Tyne, England

[21] Appl. No.: 22,793

[22] Filed: Mar. 6, 1987

[30] Foreign Application Priority Data

Mar. 15, 1986 [GB] United Kingdom ..... 8606442

[51] Int. Cl.[4] ..... H01R 13/44

[52] U.S. Cl. ..... 439/148; 439/587; 439/490; 439/415; 439/416

[58] Field of Search ..... 339/113 L, 36, 38, 113 R, 339/59 R, 60 R, 60 C, 150 B, 151 B, 147 P, 167, 169

[56] References Cited

U.S. PATENT DOCUMENTS

| | | | |
|---|---|---|---|
| 1,998,129 | 4/1935 | Fullman | 339/38 |
| 3,585,568 | 6/1971 | Hervig et al. | 339/60 R |
| 3,980,374 | 9/1976 | Fallot | 339/60 C |

*Primary Examiner*—Gil Weidenfeld.
*Assistant Examiner*—Paula A. Austin
*Attorney, Agent, or Firm*—Rosen, Dainow & Jacobs

[57] ABSTRACT

An electrical connector, e.g. a bushing, has an insulating body through which conductors form a continuous current path between two locations. The conductors are connectable to electrical equipment, e.g. switchgear and cables, at the locations. A socket is formed in the body for receiving a complementary-shaped closure plug. The current path formed by the conductors is exposed to the interior of the socket whereby by removal of the closure plug, the current path is accessible for test or isolation connections.

9 Claims, 2 Drawing Sheets

ELECTRICAL CONNECTORS

BACKGROUND OF THE INVENTION

The invention relates to electrical connectors.

In many forms of electrical equipment, for example electrical switchgear, it is necessary to provide access to live test points whereby the equipment can be tested. In some instances, test points are provided within the equipment (for example oil-filled switchgear) and are connectable to test equipment by special plugs or probes. In other arrangements, the cable connection can have a removable link; or, when plug-and-socket type connections are used, by the disconnection of the plug and socket. In the latter instance, this can be a difficult operation to perform owing to the size of cables involved in such high voltage connections, particularly in other than cable-to-cable connections in which the static nature of the equipment, e.g. a transformer, prevents or limits the manoeuvrability of one of the components.

Proposals have been made to overcome such difficulties. For example, UK Patent Application Publication No. 2154382A proposes an electrical connector having a socket which is adapted to receive a plurality of plugs to achieve through connection, isolationa nd testing. However, such connectors are relatively complex in shape and required the provision of several components, which factors are likely to add to the cost of the connectors. Furthermore, in use, such connectors require the plug achieving through connection to be removed, i.e. a disconnection to be made, before testing or isolation can be achieved.

In many applications, there is no requirement for a disconnection facility to be provided additionally to a test point or a voltage transformer, an earthing or like facility.

SUMMARY OF THE INVENTION

It is an object of the present invention to provide an electrical connection which is relatively simple in construction and which provides a test point or voltage transformer, an earthing or like facility.

According to the present invention, an electrical connector comprises a body of insulating material having at least one socket leading therein for receiving, in use, a complementary-shaped closure member and conductor means embedded in said body, said conductor means being exposed to the interior of said socket and providing a continuous current path through said body between at least two locations said conductor means being connectable at each of said locations to other electrical equipment.

In one form of the invention, said body comprises at least three limbs each having a respective socket and each having one said location.

In another form of the invention said connector comprises a bushing.

In a preferred aspect of the present invention, a bushing for electrically connecting electrical equipment contained in an enclosure with a cable outside the enclosure comprises a body of insulating material adapted to extend through an aperture in and to be secured in sealed relationship with a wall of said enclosure, said body having at least one socket leading therein for receiving, in use, a complementary-shaped closure member, and conductor means embedded in said body, said conductor means being exposed to the interior of said socket and providing a continuous current path through said body between at least two locations whereby said conductor means is connectable at said locations to said eequipment and to said cable, respectively.

Preferably, said socket tapers towards the inner end thereof.

In accordance with the invention, said closure member takes several forms. In one form, said closure member comprises a plug of insulating material to seal the socket from the external environment. In another form, said closure member comprises a connector for connecting said conductor means to earth, to test equipment, to a voltage transformer or to indicator means for example. In yet another form, said closure member comprises a plug in which is encapsulated a capacitive screen connected to a neon indicator.

BRIEF DESCRIPTION OF THE DRAWINGS

Electrical connectors will now be described to illustrate the invention by way of example only with reference to the accompanying drawings, in which.

DESCRIPTION OF THE PREFERRED EMBODIMENTS

Figure 1:
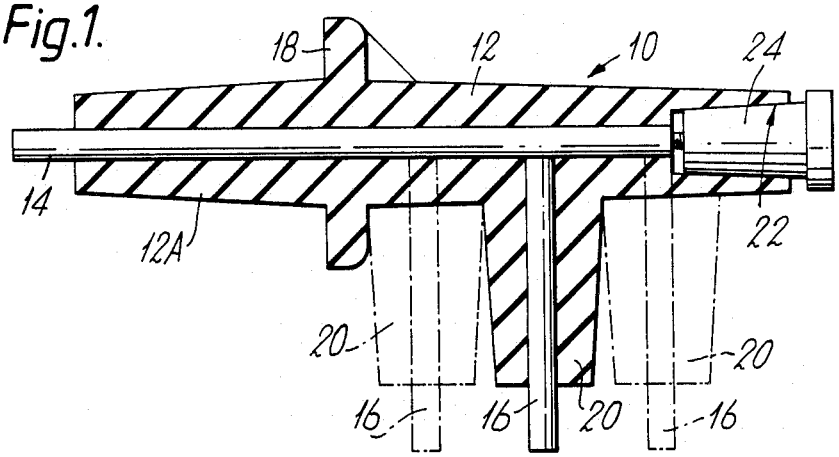
FIGS. 1 to 3 are scehmatic longitudinal sections through different embodiments of bushings according to the invention.

In the drawings, the same reference numerals have been used for like parts. Where necessary a suitable prefix or suffix has been added to the reference numeral.

Referring to FIG. 1, a bushing 10 has a body 12 of insulating material and conductor means in the form of two conductors 14, 16 embedded in the body 12 and which form a continuous current path through the body 12.

The body 12 is formed with an integral flange 18; a side limb 20 substantially at right angles thereto; and, in one end thereof, a socket 22.

One conductor 14 extends from the inner end of the socket 22, at which it is exposed to the interior thereof, through the body 12 to a first location at the left at which it protrudes from the body 12. The other conductor 16 is joined to the conductor 14 and extends substantially at right angles therefrom through to the side limb 20 to a second location at the bottom at which it protrudes from the side limb 20.

Figure 4:
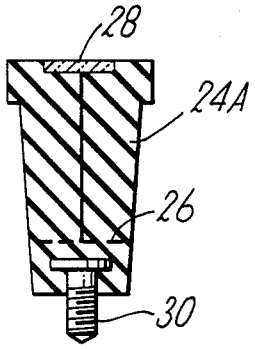
FIGS. 4 and 5 are schematic longitudinal sections through alternative forms of closure members for use with electrical connectors according to the invention.
Figure 5:
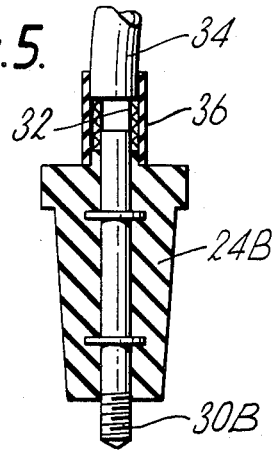

The socket 22 tapers toward the inner end thereof. A complementary-shaped closure member in the form of a plug 24 of insulating material closes the socket 22 to seal the socket 22 against the external environment. A threaded metal insert (see 30 in FIGS. 4 and 5) is located in the inner end of the plug 24 for engaging a complementary screw thread formed in the end of the conductor 14.

In use, the end 12a of the body 12 extends through an aperture in the wall of an enclosure (not shown) for electrical equipment such as circuit-breakers, switches, fuses and transformers. The bushing 10 is securable in sealed relationship with the wall by the flange 18 of the body 12. The end of the conductor 14 at the first location is connected to the electrical equipment by any suitable means. The end of the conductor 16 at the second location is connected to the end of a cable (not shown) by a crimpled sleeve, for example, the joint being insulated by a heat-shrunk insulating sleeve, for example.

Figure 2:
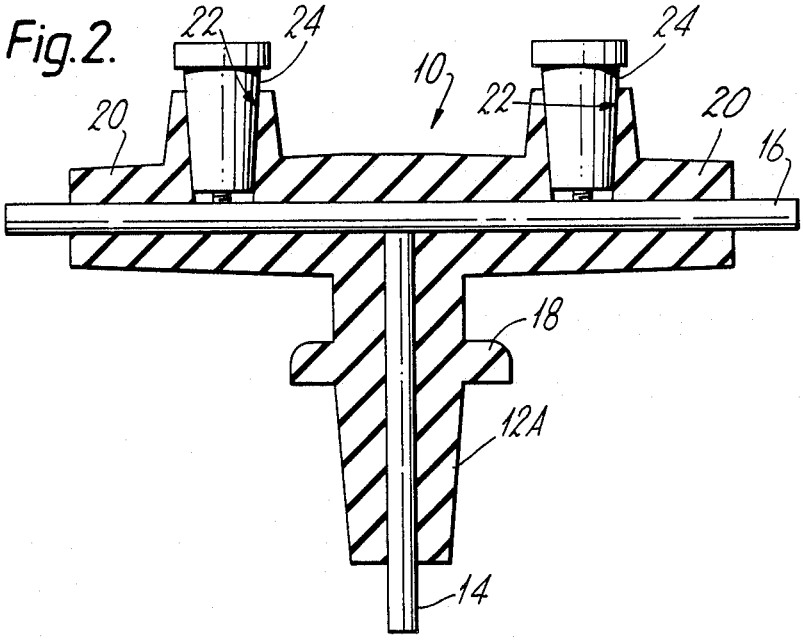

If it is desired to supply electricity to more than one cable or to voltage transformers, for example, the bushing 10 is made with additional side limbs 20 and corresponding conductors 16 as shown in ghost outline in FIG. 1; or, alternatively, as shown in FIG. 2 in which a bushing 10 in the form of a T-junction is shown.

In the embodiment shown in FIG. 2, a socket 22 is provided in each side limb 20 of the bushing 10. In this instance, the conductor 16 extends through both side limbs 20, is exposed to the interior of each of the sockets 232 and protrudes from the body 12 at respective second locations for connection to separate cables.

Figure 3:
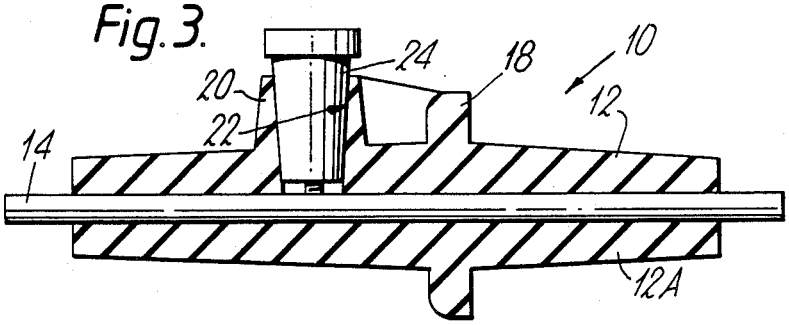

In the embodiment shown in FIG. 3, the conductor 16 is omitted and the conductor 14 extends through the body 12 to first and second locations at either end at which it protuudes from the body. The conductor 14 is exposed to the interior of the socket 22 which, in this embodiment, is formed in the side limb 20, The threaded insert of the plug 24 engages a complementary thread which extends transversely of the conductor 14.

It will be appreciated that the current path through the bushing 10 can be at angles other than the 90° and 180° shown in FIGS. 1 to 3.

If it is a requirement that the conductor means 14, 16 are shown to be live, a plug 24A (see FIG. 4) having a capacitive screen 26 connected to a neon indicator 28, for example, is substituted for the plug 24.

To connect the conductor means 14, 16 to the other indicator or test equipment; a voltage transformer; or to earth, a plug 24B (see FIG. 5) having a metal insert 30B which extends completely through the plug to protrude thereform. The end of the insert 30B is connected by a crimped sleeve 32 to a cable 34, the joint being insulated by a heat-shrunk sleeve 36, for example.

Figure 6:
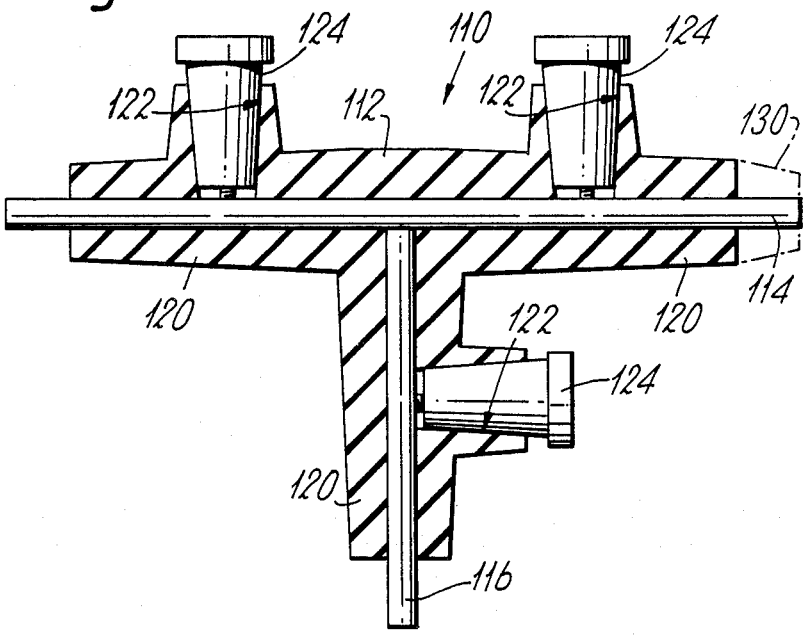
FIG. 6 is a schematic longitudinal section through a further embodiment of an electrical connector according to the invention.

In the embodiment shown in FIG. 6, an electrical connector 110 for forming a cable T-junction has a body 112 consisting of three substantially identical limbs 120 forming a T-shape. A conductor 114 passes through the two limbs 120 forming the bar of the T-shaped to protrude from opposite ends thereof. A conductor 116 is connected to the conductor 114 and passes through the limb 120 forming the upright of the T-shape to protrude from the end thereof. Each limb 120 has a respective socket 122 and a plug 124. The protruding ends of the conductors 114, 116 are connectable to cables substantially as previously described.

The connectors 10, 110 described with reference to the accompanying drawings are used for one phase if there is only one or each phase of the supply if there are more than one. However, in a modification (not shown), for a multiphase supply, a single connector having conductor means and respective sockets for each phase of the supply can be used.

It will be appreciated that connectors having other geometries to those shown are within the scope of the invention.

Also, more than one socket 22, 122 can be provided in each limb whereby, for example, a voltage transformer (or other equipment) can remain connected to the conductor means via one socket whilst test equipment (or other equipment) can be connected to the conductor means via a second socket. Alternatively, in the case of the connector configuration shown in FIG. 6, for example, a voltage transformer can remain connected to the conductor means via the socket in one limb whilst test equipment can be connected to the conductor means via the socket in another limb. Othe rpossible configurations will be apparent to those skilled in the art.

The bodies 12, 112 of the connectors 10, 110 can be made of any suitable insulating material. If required, the bodies 12, 112 can be cast with tapered portions (for example as shown in ghost outline at 130 in FIG. 6) whereby the connections to the conductors 14, 114, 16, 116 can be made by complementary sockets attached to the ends of the cables. Clearly other plug/socket configurations can be used. The conductors 14, 114, 16, 116, 38 are typically made of copper or aluminium.

In this specification, the term "electrical equipment" has been used to mean cables as well as other apparatus such as switchgear, transformers etc. Thus, as exemplified by the embodiment shown in FIGS. 6, electrical connectors constructed in accordance with the invention can be used for cable-to-cable connections as well as cable-to-apparatus connections.

We claim:

1. An electrical connector for at least one phase of electrical current comprising:

a body of insulating material having for each phase at least one socket portion leading therein for receiving, in use, a complementary-shaped closure means, conductor means embedded in said insulating body, at least two locations at said insulating body, said conductor means extending to and being exposed to the interior of said socket portion and extending between said two locations and providing a continuous current path through said insulating body between said two locations, said conductor means terminating at each of said locations, and connecting means at each of said two locations for connecting said conductor means to other electrical equipment.

2. A connector according to claim 1, wherein the connecting means comprises an exposed end of the conductor means.

3. A connector according to claim 1, in which the said body comprises at least three limbs each having a respective socket and each having one said location.

4. An electrical connector as a bushing for electrically connecting electrical equipment contained in an enclosure with a cable outside the enclosure, comprising a body of insulating material adapted to extend through an aperture in and to be secured in sealed relationship with a wall of said enclosure, said insulating body having at least one socket portion leading therein for receiving, in use, a complementary-shaped closure means, conductor means embedded in said insulating body, at least two locations at said insulating body, said conductor means extending to and being exposed to the interior of said socket portion and extending between said two locations and providing a continuous current path through said insulating body between said two locations, said conductor means terminating at each of said locations, and means at each of said two locations for connecting said conductor means to said electrical equipment and to said cable, respectively.

5. A connector according to claim 1 or 4, in combination with seprable closure means shaped to be received by the socket portion, and means in said closure means for effecting electrical connection to the exposed conductor means.

6. A connector according to any one of claims 1, 3 or 4, in which said socket tapers towards the inner end thereof.

7. A connector according to any one of claims 1, 3 or 4, in which said closure member comprises a connector for connecting said conductor means to other electrical equipment or to earth.

8. A connector according to any one of claims 1, 3 or 4, in which said closure member comprises a plug of insulating material.

9. A connector according to claim 8, in which said plug encapsulates a capacitive screen connected to a neon indicator.

* * * * *

UNITED STATES PATENT AND TRADEMARK OFFICE

CERTIFICATE OF CORRECTION

PATENT NO. : 4,764,123

DATED : August 16, 1988

INVENTOR(S) : Ronald Shaw, et al.

It is certified that error appears in the above-identified patent and that said Letters Patent is hereby corrected as shown below:

Column 1, line 26, change "isolationa nd" to --isolation and--;

line 28, change "required" to --require--.

Column 3, line 46, change "shaped" to --shape--.

Signed and Sealed this

Twenty-first Day of August, 1990

*Attest:*

HARRY F. MANBECK, JR.

*Attesting Officer*

*Commissioner of Patents and Trademarks*